US010708696B2

(12) United States Patent
Ge et al.

(10) Patent No.: US 10,708,696 B2
(45) Date of Patent: Jul. 7, 2020

(54) SOUND GENERATOR

(71) Applicant: AAC Technologies Pte. Ltd., Singapore (SG)

(72) Inventors: Jiwei Ge, Shenzhen (CN); Rongguan Zhou, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/233,393

(22) Filed: Dec. 27, 2018

(65) Prior Publication Data

US 2019/0208327 A1 Jul. 4, 2019

(30) Foreign Application Priority Data

Jan. 3, 2018 (CN) ..... 2018 1 0003209

(51) Int. Cl.

| | |
|---|---|
| ***H04R 9/04*** | (2006.01) |
| ***H04R 1/02*** | (2006.01) |
| ***H04R 9/06*** | (2006.01) |
| ***H04R 7/04*** | (2006.01) |
| ***H04R 11/02*** | (2006.01) |

(52) U.S. Cl.

CPC ..... *H04R 9/046* (2013.01); *H04R 1/02* (2013.01); *H04R 1/021* (2013.01); *H04R 7/04* (2013.01); *H04R 9/045* (2013.01); *H04R 9/06* (2013.01); *H04R 11/02* (2013.01); *H04R 2400/11* (2013.01); *H04R 2499/11* (2013.01)

(58) Field of Classification Search

CPC ..... H04R 9/046; H04R 9/045; H04R 1/02; H04R 9/06; H04R 2499/11; H04R 2400/11

See application file for complete search history.

(56) References Cited

U.S. PATENT DOCUMENTS

2006/0039575 A1* 2/2006 Wada ..... H04R 1/025 381/152
2012/0207321 A1* 8/2012 Oshima ..... H04R 9/045 381/86

FOREIGN PATENT DOCUMENTS

CN 203193871 B1 9/2013
CN 205961447 B1 2/2017

OTHER PUBLICATIONS

Chinese Office Action dated Jul. 19, 2019 in related Chinese Patent Application No. 201810003209.1 (10 Pages).

* cited by examiner

*Primary Examiner* — Sunita Joshi
(74) *Attorney, Agent, or Firm* — IPro, PLLC; Na Xu

(57) ABSTRACT

The present application discloses a sound generator, including: a panel; a housing including a substrate and a frame extending from the substrate; a space formed by the panel and the housing; a driving member; a first sliding guide; a first sliding block slidably connected with the first sliding guide; a second sliding guide; a second sliding block slidably connected with the second sliding guide; a support mounted on the substrate and including a pivot; and a linking pole pivotally connected to the pivot. The linking pole includes an end movably connected to the first sliding block and another end movably connected to the second sliding block; and a distance from the pivot to the first sliding block is smaller than a distance from the pivot to the second sliding block.

5 Claims, 2 Drawing Sheets

SOUND GENERATOR

FIELD OF THE PRESENT DISCLOSURE

The present disclosure relates to the field of electroacoustic components, and more particularly to a sound generator using a display of an electrical device to radiate sound.

DESCRIPTION OF RELATED ART

With the development of mobile internet, smart devices are widely used by population. A smart mobile phone is the most important one of these devices. A component that can reproduce audible sounds (music) is widely used in the mobile phone. Such a component is called miniature speaker. For satisfying the demands of high-quality sound, miniature, stereo-sound, the miniature speaker is focused by the designers. A vibration system and a magnetic circuit system directly affect the sound quality of a miniature speaker.

Besides the miniature speaker, the device has another solution to produce sound, i.e., the "audio display". An audio display is a combination of a vibrator and a display (screen), and the vibrator is used to drive the screen to vibrate and further to produce sound. Generally, the vibrator should be capable of providing adequate vibration force to drive the screen, meanwhile the vibrator occupies additional space, which increases the cost and makes the device thicker.

Therefore, it is desired that an improved sound generator can overcome the disadvantages mentioned above.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to exemplary embodiment. To make the technical problems to be solved, technical solutions and beneficial effects of the present disclosure more apparent, the present disclosure is described in further detail together with the figures and the embodiment. It should be understood the specific embodiment described hereby are only to explain the disclosure, not intended to limit the disclosure.

Figure 1:
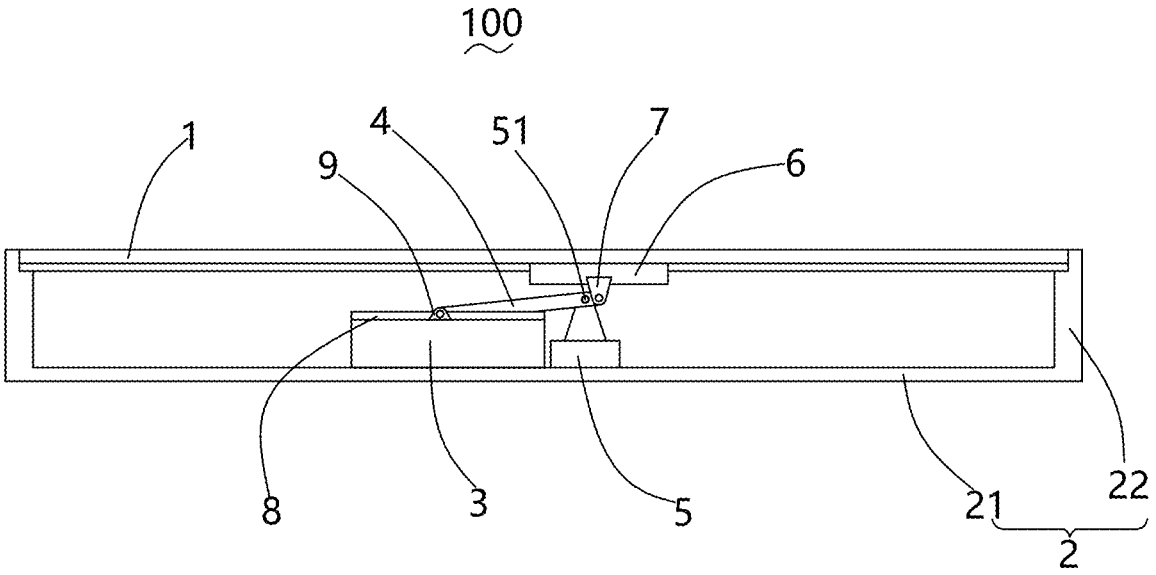
FIG. 1 is an illustrative view of sound generator in accordance with an exemplary embodiment of the present invention.

Referring to FIG. 1, a sound generator 100, in accordance with an exemplary embodiment of the present invention, comprises a panel 1, a housing 2, a driving member 3, a linking pole 4, a support 5, a first sliding guide 6, a first sliding block 7, a second sliding guide 8 and a second sliding block 9. The panel 1, according to actual design, may be a screen for displaying images or videos, or a back cover of a portable device like a mobile phone, or a side frame of a device. The panel 1 and the housing cooperatively form a receiving space for accommodating the driving member 3, the linking pole 4, the support 5, the first sliding guide 6, the first sliding block 7, the second sliding guide 8 and the second sliding block 9. The panel 1 provides the first sliding guide 6 with a mounting position.

The housing 2 includes a substrate 21 for providing a mounting position for the driving member 3 and the support 5, and a frame 22 extending from the substrate 21 toward the panel 1.

Figure 2:
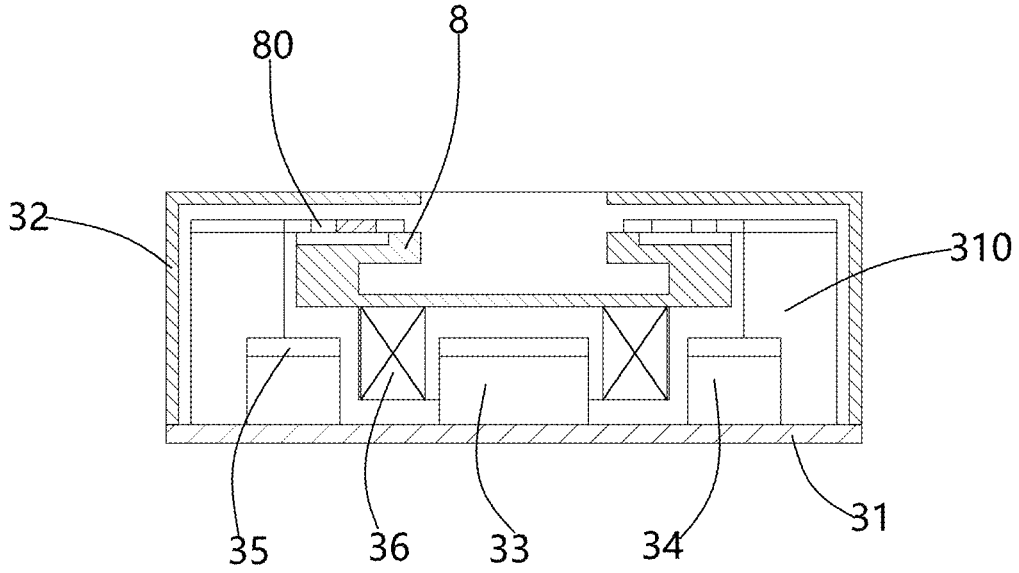
FIG. 2 is a cross-sectional view of a driving member of the sound generator in FIG. 1.

Referring to FIG. 2, the driving member 3 is positioned on the substrate 21. The driving member 3 includes a base 31, a cover 32, a main magnet 33, an auxiliary magnet 34, a pole plate 35 and a driving coil 36. The base 31 and the cover 32 cooperatively form a space for receiving the main magnet 33, the auxiliary magnet 34, the pole plate 35 and the driving coil 36. The base 31 is substantially rectangular and includes supporting poles 310 at four corners thereof. The main magnet 33 is mounted on the base 31, and the auxiliary magnet includes at least two magnets surrounding the main magnet 33 for forming a magnetic gap. The pole plate 35 covers the main magnet and the auxiliary magnets 34. The driving coil 36 has one end suspended in the magnetic gap for producing electro-magnetic force, and another end fixed to the second sliding guide 8.

Figure 3:
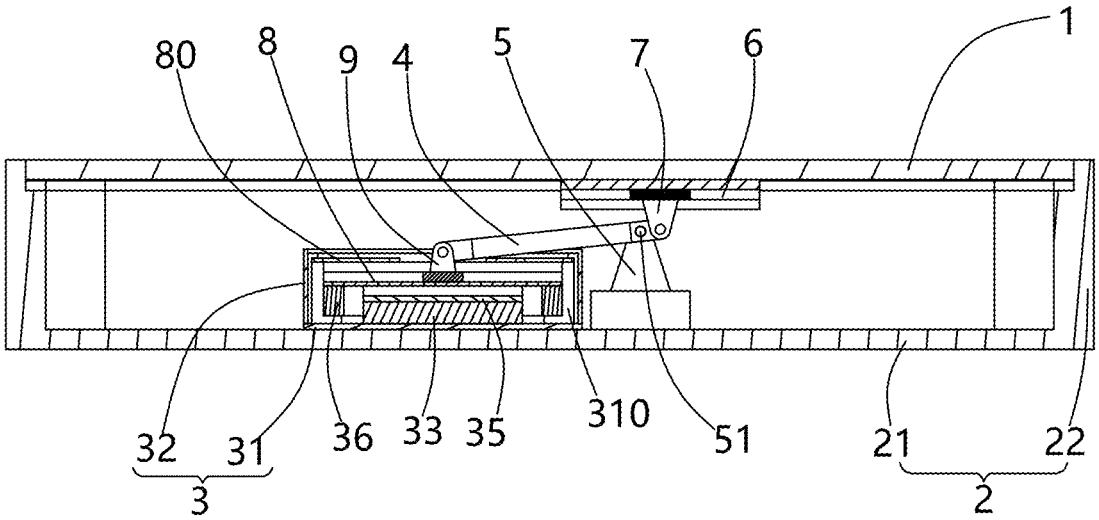
FIG. 3 is an illustrative view of a linking pole of the sound generator.

Referring to FIG. 3, the linking pole 4 is used for transmitting force, with one end thereof movable connected to the first sliding block 7 and another end thereof movable connected to the second sliding block 9. The linking pole 4 is connected to the support 5. Preferably, the linking pole 4 is pivotally connected to the first sliding block 7 and the second sliding block 9.

The support 5 is adjacent to the driving member 3 and is positioned on the substrate 21. The support 5 includes a pivot 51 connecting to the linking pole 4 for making the linking pole 4 be capable of rotating on the pivot 51. A distance from the pivot 51 to a joint where the linking pole 4 connects the first sliding block 7 is smaller than a distance from the pivot 51 to a joint where the linking pole 4 connects the second sliding block 9, which enlarges the driving force produced by the driving member 3 applied on the panel 1.

The first sliding guide 6 is positioned on the panel 1 on a side opposite to the housing 2. The first sliding block 7 is slidably connected to the first sliding guide 6, and is movable along a long axis of the first sliding guide 6.

The second siding block 8 is fixed to the driving coil 36. The second sliding block 9 is slidably connected to the second sliding guide 8, and the second sliding block 9 is movable along a long axis of the second sliding guide 8.

Figure 4:
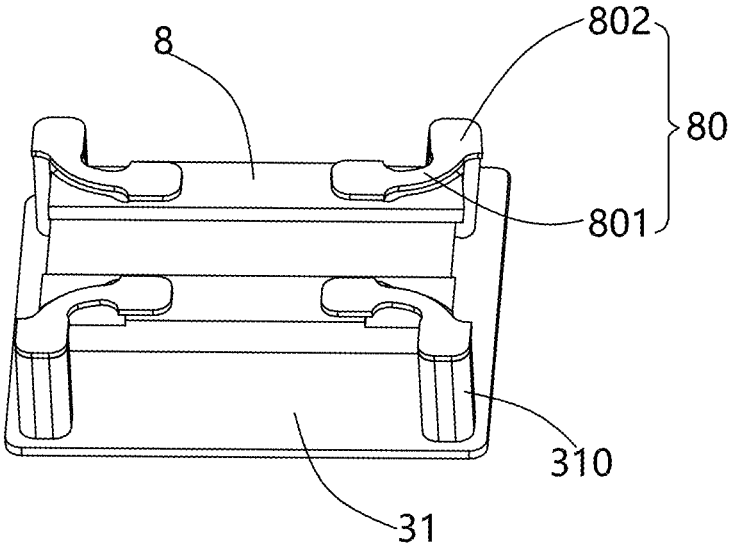
FIG. 4 is an illustrative view of a second sliding guide of the sound generator.

Referring to FIG. 4, the second sliding guide 8 includes a supporting spring 80 with an arc shape. The supporting spring 80 includes an elastic arm 801 and a pair of fastening portions 802 extending respectively from two ends of the elastic arm 801. The two fastening portions 802 respectively fixed to the second sliding guide 8 and the supporting pole 310. The supporting spring 80 is used for supporting the second sliding guide 8 and providing restoring force to the second sliding guide 8. The supporting spring 80 includes a plurality of springs arranged in a matrix.

The connection between the first sliding guide 6 and the first sliding block 7, and the connection between the second sliding guide 8 and the second sliding block 9 prevent longitudinal component of force, and ensure that the panel 1 is driven by driving force along a direction perpendicular to the panel 1.

Compared with related art, in the invention, the linking pole 4 connects to the driving member 3 and the first sliding guide 6, and the distance from the pivot 51 to the driving member is greater than the distance from the pivot to the first sliding guide 6, by which the driving force applied to the panel 1 is enlarged. The driving member 3 is capable of being designed smaller.

The connection between the first sliding guide 6 and the first sliding block 7, and the connection between the second sliding guide 8 and the second sliding block 9 prevent longitudinal component of force, and ensure that the panel 1 is smoothly driven by driving force along a direction perpendicular to the panel 1.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A sound generator, including:

a panel;

a housing including a substrate and a frame extending from the substrate toward the panel;

a space formed by the panel and the housing;

a driving member mounted on the substrate;

a first sliding guide mounted on a side of the panel facing the substrate;

a first sliding block slidably connected with the first sliding guide;

a second sliding guide driven by the driving member;

a second sliding block slidably connected with the second sliding guide;

a support mounted on the substrate and including a pivot;

a linking pole pivotally connected to the pivot; wherein the linking pole includes an end movably connected to the first sliding block and another end movably connected to the second sliding block; and a distance from the pivot to the first sliding block is smaller than a distance from the pivot to the second sliding block; wherein the driving member includes a base, a cover engaging with the base, a main magnet on the base, a plurality of auxiliary magnets surrounding the main magnet, a magnetic gap formed by the main magnet and the auxiliary magnets, a pole plate covering the main and auxiliary magnets, and a driving coil with an end suspended in the magnetic gap and another end fixed to the second sliding guide.

2. The sound generator as described in claim 1, wherein two ends of the linking pole are respectively pivotally connected to the first sliding block and the second sliding block.

3. The sound generator as described in claim 1 further including a plurality of supporting poles mounted on the base and a supporting spring including an end connected to the supporting pole and another end fixed to the second sliding guide.

4. The sound generator as described in claim 3, wherein amount of the supporting poles is four, and the supporting spring includes four springs, the supporting poles are arranged at four corners of the base.

5. The sound generator as described in claim 4, wherein the supporting spring includes an elastic arm and a pair of fastening portions extending respectively from two ends of the elastic arm and respectively fixed to the second sliding guide and the supporting pole.

* * * * *